US011273352B1

(12) United States Patent
Martin

(10) Patent No.: US 11,273,352 B1
(45) Date of Patent: Mar. 15, 2022

(54) GAME KIT AND METHOD OF PLAYING AN OUTDOOR TOSSING GAME

(71) Applicant: Christopher C. Martin, Matthews, NC (US)

(72) Inventor: Christopher C. Martin, Matthews, NC (US)

( * ) Notice: Subject to any disclaimer, the term of this patent is extended or adjusted under 35 U.S.C. 154(b) by 0 days.

(21) Appl. No.: 14/329,110

(22) Filed: Jul. 11, 2014

Related U.S. Application Data

(60) Provisional application No. 61/845,168, filed on Jul. 29, 2013.

(51) Int. Cl.
*A63B 67/06* (2006.01)
*A63B 65/00* (2006.01)
*A63B 71/06* (2006.01)

(52) U.S. Cl.
CPC ..... *A63B 67/06* (2013.01); *A63B 65/00* (2013.01); *A63B 71/06* (2013.01)

(58) Field of Classification Search
CPC ..... A63B 67/06; A63B 71/06; A63B 65/00
USPC ..... 473/469, 470, 471
See application file for complete search history.

(56) References Cited

U.S. PATENT DOCUMENTS 1,385,642 A * 7/1921 Restein ..... A63B 15/00 482/108
1,556,511 A * 10/1925 Dobbins ..... G09F 13/24 40/406
2,377,498 A * 6/1945 Jacke ..... A63B 67/086 473/569
3,810,411 A * 5/1974 Schambacher ..... G10G 7/00 84/477 B
3,862,758 A * 1/1975 McLamb ..... A63B 67/06 273/393
4,204,682 A 5/1980 Brown
4,253,673 A * 3/1981 Bailey ..... A63B 67/00 206/579
4,928,977 A * 5/1990 Chambers ..... A63B 67/086 473/569
5,092,807 A * 3/1992 Lew ..... F21L 4/00 428/13
5,188,358 A * 2/1993 Glass ..... A63B 67/002 473/325

(Continued)

OTHER PUBLICATIONS

Webpage download, Thepaintedblackbird2012, 2012, www.thepaintedblackbird.com/2012/09/joburg-art-map-love.html, 4 pages.*

*Primary Examiner* — Jeffrey S Vanderveen
(74) *Attorney, Agent, or Firm* — Schwartz Law Firm, P.C.

(57) ABSTRACT

A game kit for a multi-player or single player outdoor tossing game includes a set of at least two elongated rigid pitch sticks. The pitch sticks are adapted to be tossed from a pitch location towards a remote target location. A first pitch stick has first and second visually contrasted stick sections. The first stick section comprises a first color identifier and a first point-indicating marking. The second stick section comprises a second color identifier and a second point-indicating marking. A second pitch stick has first and second visually contrasted stick sections. The first stick section of the second stick comprises the first color identifier of the first stick, and a third point-indicating marking. The second stick section of the second stick comprises the second color identifier of the first stick, and a fourth point-indicating marking.

13 Claims, 4 Drawing Sheets

(56) References Cited

U.S. PATENT DOCUMENTS

| | | | | |
|---|---|---|---|---|
| 5,358,256 | A * | 10/1994 | Kraemer | A63B 67/06 273/401 |
| 6,430,819 | B1 * | 8/2002 | Aldstadt | A63C 19/06 33/1 G |
| 8,011,660 | B1 | 9/2011 | Butler | |
| 2002/0033575 | A1 | 3/2002 | Rader | |

* cited by examiner

GAME KIT AND METHOD OF PLAYING AN OUTDOOR TOSSING GAME

TECHNICAL FIELD AND BACKGROUND OF THE INVENTION

This invention relates broadly and generally to a game kit and method of playing an outdoor tossing game. Exemplary games may be played on any desired playing surface including lawns, the beach, parking lots and other paved surfaces, indoor gymnasiums, or the like.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a game kit for a multi-player or single player outdoor tossing game. The kit includes a set of elongated rigid pitch sticks adapted to be tossed from a pitch location towards a remote target location. The set comprises (at least) first and second pitch sticks. The first pitch stick has first and second visually contrasted stick sections. The first stick section comprises a first color identifier and a first point-indicating marking. The second stick section comprises a second color identifier and a second point-indicating marking.

The second pitch stick has first and second visually contrasted stick sections. The first stick section of the second stick comprises the first color identifier of the first stick, and a third point-indicating marking. The second stick section of the second stick comprises the second color identifier of the first stick, and a fourth point-indicating marking.

According to another exemplary embodiment, the first and second visually contrasted stick sections of each pitch stick comprise substantially equal length-divided halves of the pitch stick.

According to another exemplary embodiment, the first and second color identifiers of the first and second pitch sticks comprise respective solid colors. Each solid color extends substantially from a midpoint of the pitch stick outwardly to an end of the pitch stick.

According to another exemplary embodiment, the first point-indicating marking comprises a single color-contrasted band located within the first stick section of the first pitch stick. The second point-indicating marking comprises four spaced apart color-contrasted bands located within the second stick section of the first pitch stick. The third point-indicating marking comprises two spaced apart color-contrasted bands located within the first stick section of the second pitch stick. The fourth point-indicating marking comprises three spaced apart color-contrasted bands located within the second stick section of the second pitch stick.

According to another exemplary embodiment, each pitch stick is constructed substantially of wood.

According to another exemplary embodiment, rubber end caps are applied to respective ends of each pitch stick.

According to another exemplary embodiment, each pitch stick has a total length of between about 20 and 28 inches, and a diameter of between about 0.75 and 1.25 inches.

According to another exemplary embodiment, the game kit includes a target adapted for being placed at (or tossed to) the remote target location.

According to another exemplary embodiment, the game kit further includes means for measuring a distance extending from said target. Exemplary means may include a flexible string, ruler, elongated telescoping pole, electronic or laser measuring devices, or the like.

In another exemplary embodiment, the disclosure comprises a game kit for a multiple or single player outdoor tossing game. The game kit includes first and second sets of elongated rigid pitch sticks—the first set comprising first and second pitch sticks, and the second set comprising third and fourth pitch sticks. The pitch sticks are adapted to be tossed from a pitch location towards a remote target location.

The first pitch stick has first and second visually contrasted stick sections. The first stick section comprises a first color identifier and a first point-indicating marking. The second stick section comprises a second color identifier and a second point-indicating marking.

The second pitch stick has first and second visually contrasted stick sections. The first stick section comprises the first color identifier of the first stick, and a third point-indicating marking. The second stick section comprises the second color identifier of the first stick, and a fourth point-indicating marking.

The third pitch stick has first and second visually contrasted stick sections. The first stick section comprises a third color identifier, and the first point-indicating marking of the first stick. The second stick section comprises a fourth color identifier, and the second point-indicating marking of the first stick.

The fourth pitch stick has first and second visually contrasted stick sections. The first stick section comprises the third color identifier of the third stick, and the third point-indicating marking of the second stick. The second stick section comprises the fourth color identifier of the third stick, and the fourth point-indicating marking of the second stick.

According to another exemplary embodiment, the first point-indicating marking comprises a single color-contrasted band located within the first stick section of the first and third pitch sticks. The second point-indicating marking comprises four spaced apart color-contrasted bands located within the second stick section of the first and third pitch sticks. The third point-indicating marking comprises two spaced apart color-contrasted bands located within the first stick section of the second and fourth pitch sticks. The fourth point-indicating marking comprises three spaced apart color-contrasted bands located within the second stick section of the second and fourth pitch sticks.

In yet another exemplary embodiment, the present disclosure comprises a method for playing an outdoor tossing game. The method includes tossing first and second elongated rigid pitch sticks from a pitch location to a remote target location.

The first pitch stick includes first and second visually contrasted stick sections. The first stick section comprises a first color identifier and a first point-indicating marking. The second stick section comprises a second color identifier and a second point-indicating marking.

The second pitch stick includes first and second visually contrasted stick sections. The first stick section comprises the first color identifier of the first stick, and a third point-indicating marking. The second stick section comprises the second color identifier of the first stick, and a fourth point-indicating marking.

According to another exemplary embodiment, the method includes tossing a third elongated rigid pitch stick from the pitch location toward the remote target location. The third pitch stick includes first and second visually contrasted stick sections. The first stick section comprises a third color identifier, and the first point-indicating marking of the first stick. The second stick section comprises a fourth color identifier, and the second point-indicating marking of the first stick.

According to another exemplary embodiment, the method includes tossing a fourth elongated rigid pitch stick from the pitch location toward the remote target location. The fourth pitch stick includes first and second visually contrasted stick sections. The first stick section comprises the third color identifier of the third stick, and the third point-indicating marking of the second stick. The second stick section comprises the fourth color identifier of the third stick, and the fourth point-indicating marking of the second stick.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Exemplary Game Kit

Figure 1:
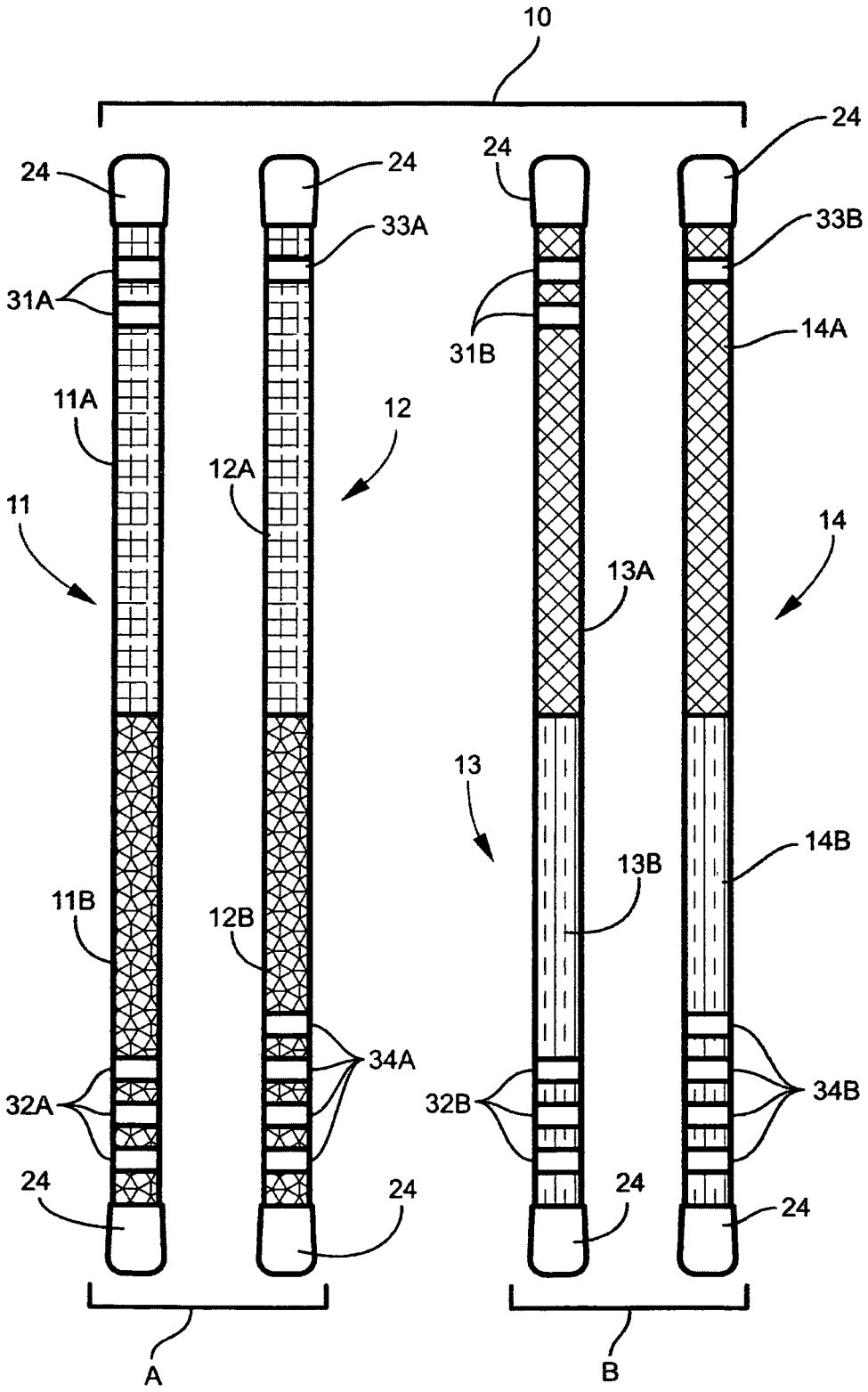
FIG. 1 is a view illustrating exemplary pitch sticks according to one exemplary embodiment of the present disclosure.
Figure 2:
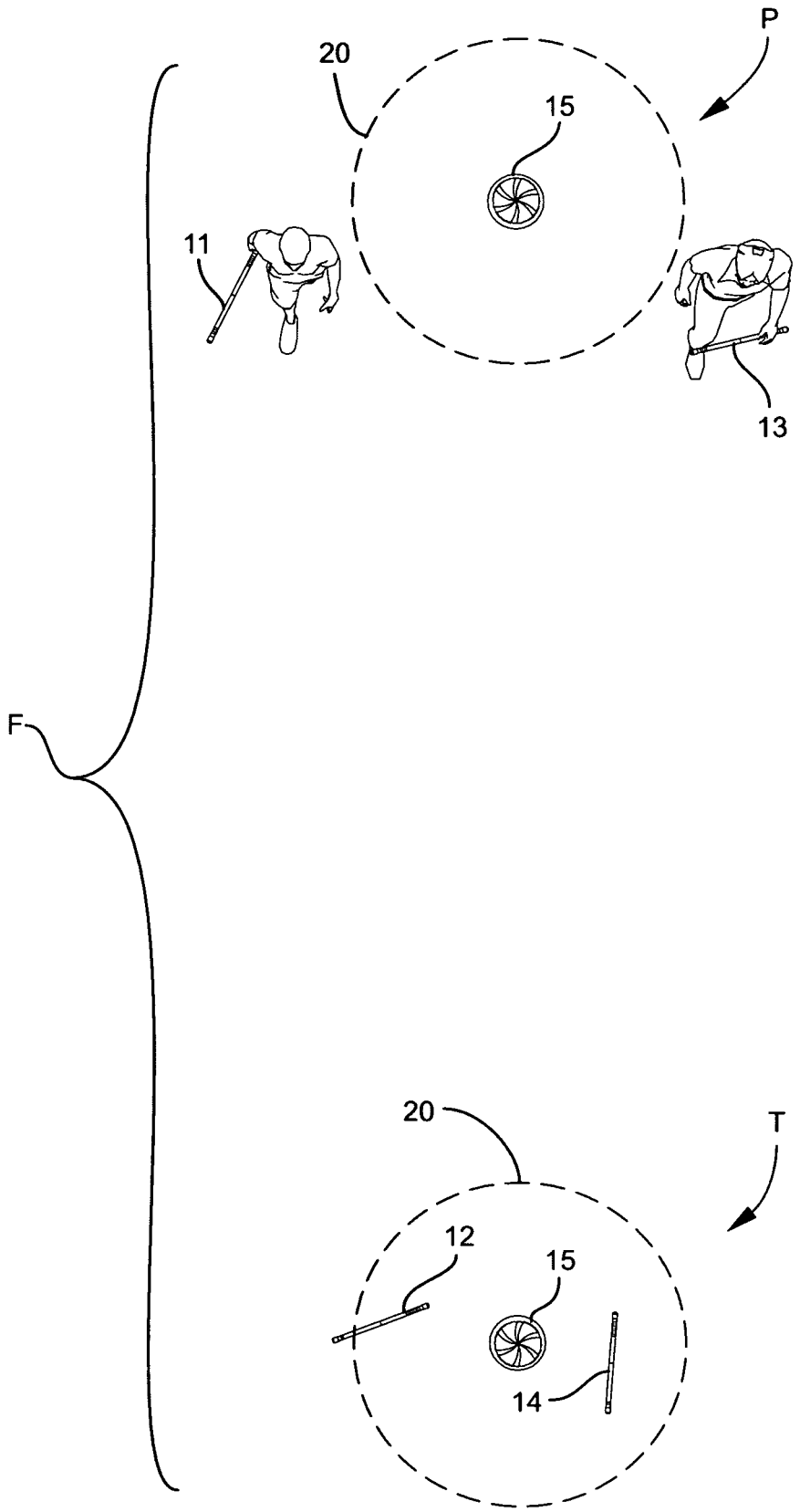
FIG. 2 illustrates components of the exemplary game kit used on a playing field with spaced apart targets.

Referring now specifically to the drawings, the exemplary game kit 10 of the present disclosure comprises at least two sets of elongated rigid pitch sticks, shown in FIG. 1—the first game set "A" comprising first and second pitch sticks 11, 12, and the second game set "B" comprising third and fourth pitch sticks 13, 14. As best shown in FIG. 2, the exemplary pitch sticks 11-14 are adapted to be tossed by two or more players in an outdoor game from a pitch location "P" towards a remote target location "T". The target location "T" may be identified by a flying disc-shaped object 15, such as a 9-inch FRISBEE® toy, or other suitable permanently staked or readily repositioned target. Respective targets 15 may be located on opposite ends the playing field "F". In one or more outdoor games, discussed further below, a distance measurer 18 (e.g., flexible string, ruler, or the like) may be attached to or proximate the target 15 and may be used to measure a predetermined "point zone" 20 surrounding each target 15. As demonstrated in FIG. 3, the distance measurer 18 (e.g., string) may also be used to determine which pitch stick 11-14 is nearest the target 15—moving the measurer 18 in a generally circumferential path about the staked target 15 as indicated by arrows 21, 22. According to one embodiment, the pitch sticks 11-14 are constructed substantially of solid wood or other lightweight material (e.g., fiberglass, metal, PVC); and each has a total length of between about 20 and 28 inches, and a diameter of between about 0.75 and 1.25 inches. Protective rubber end caps 24 may be applied to opposite ends of each stick 11-14 for personal safety and added durability.

In the first game set "A", the first and second pitch sticks 11, 12 are generally assigned to a first game player, and have identical visually-contrasted stick sections 11A, 11B and 12A, 12B comprising respective color identifiers. For example, substantially one half of the pitch stick 11, 12 in the first stick section 11A, 12A may be colored (e.g. painted) solid blue, while substantially the other half of the pitch stick 11, 12 in the second stick section 11B, 12B may be colored (e.g., painted) solid red. This particular color combination for both pitch sticks 11, 12 in the first game "A" set is identical. In addition, the first pitch stick 11 has first and second point-indicating markings 31A, 32A at its opposite ends. In the embodiment shown, the point-indicating markings 31A, 32A comprise two spaced apart color-contrasted bands at one end of the stick 11, and three equally spaced apart color-contrasted bands at the opposite end of the stick 11. The second pitch 12 stick has third and fourth point-indicating markings 33A, 34A located at its opposite ends, and distinct from each of the first and second markings 31A, 32A of the first pitch stick 11. In the present example, the third point-indicating marking 33A comprises a single color-contrasted band, while the fourth point-indicating marking 34A comprises four equally spaced apart color-contrasted bands. Each band may be relatively narrow and colored (e.g., painted) white so as to be readily visually distinguished from the otherwise solid blue and red colors of the first and second stick sections 11A, 12A and 11B, 12B.

The third and fourth pitch sticks 13, 14 of the second game set "B" are generally assigned to a second game player, and like the first game "A" set have identical visually-contrasted stick sections 13A, 13B and 14A, 14B comprising respective color identifiers. For example, substantially one half of each pitch stick 13, 14 in the first stick section 13A, 14A may be colored solid yellow, while substantially the other half of the pitch sticks 13, 14 in the second stick section 13B, 14B may be colored solid green. This color combination is identical for the pitch sticks 13, 14 of the second game set "B", and is distinct from the color combination used for the pitch sticks 11, 12 of the first game set "A". As such, each game player can readily identify his or her own pitch sticks 11-14 in any given outdoor game including those discussed below. Like the sticks 11, 12 of the first game set "A", the third and fourth pitch sticks 13, 14 have respective point-indicating markings 31B-34B at their opposite ends. As shown in FIG. 1, the first and second band markings 31B, 32B of the third pitch stick 13 are identical to the corresponding band markings 31A, 32A of the first pitch stick 11, and the third and fourth band markings 33B, 34B of the fourth pitch stick 14 are identical to the corresponding band markings 33A, 34A of the second pitch stick 12. In other words, point-indicating markings 31B and 32B comprise two and three spaced apart color contrasted (e.g., white) bands, respectively; and point-indicating markings 33B and 34B comprise a single and four spaced apart color contrasted (e.g., white) bands, respectively Exemplary Lawn Games The exemplary game kit including one or more sets of pitch sticks may be used in a variety of outdoor lawn or beach games and activities. While several game examples are described below, it is understood that many other games and activities using the exemplary pitch sticks may evolve or be developed, and game rules are subject to change in any manner as desired by the players.

(I) CRESSPO!™

Figure 3:
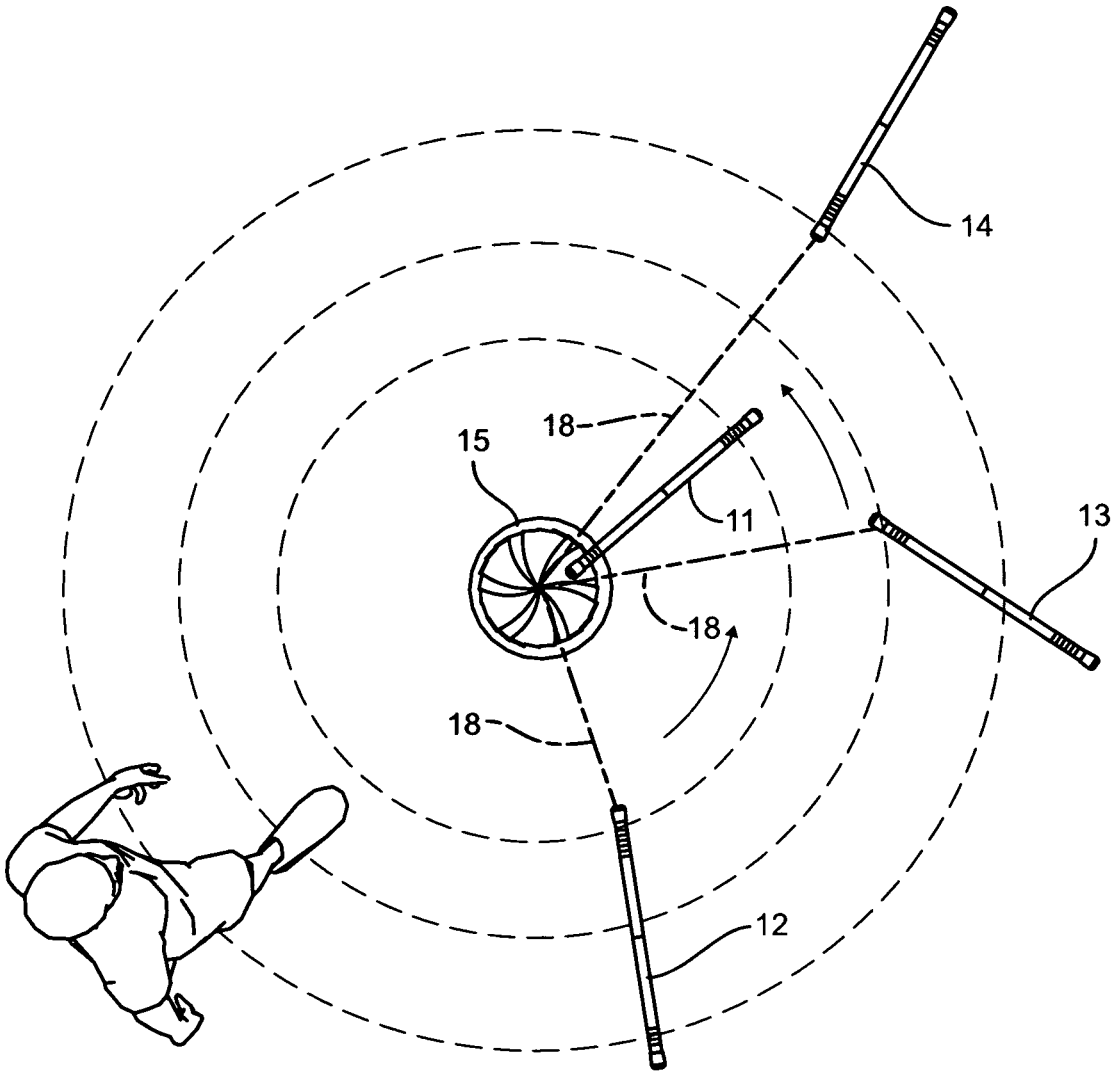
FIG. 3 demonstrates use of the measuring string (attached to a staked target at one end) for measuring the distance of the pitch sticks to the target.

One example of an outdoor game (referred to herein as CRESSPO!™) is played by 2-8 players. In the case of eight players, each of players 5-8 may be paired with one of players 1-4 to form four separate teams. Each player has 1 or 2 pitch sticks, and begins the game at a pitch location. A staked target is located 20-30 yards from the pitch location. To start, the youngest player throws his or her first pitch stick towards the target location. The next oldest player then throws his or her first pitch stick. In the case of only two players, the players alternate throws until all four pitch sticks have been tossed. For the two pitch sticks nearest the target, points are awarded based on the point-indicating markings on the stick ends most directly pointed towards the target. If the stick thrown by Player-A is nearest the target but has fewer points than the second closest stick thrown by Player-B, then Player-A and Player-B switch points. If Player-A has the two nearest pitch sticks, then Player-A is awarded points for both sticks—the awarded point total being the sum of the markings at the stick ends most directly pointed towards the target. If a player's pitch stick lands (and remains) on the target this is referred to as a "Cresspo!" and is worth 5 points. The pitch stick 11 shown in FIG. 3 is a Cresspo!. If a player throws a Cresspo! and has the second nearest pitch stick to the target, he or she also adds the points associated with markings of the stick end most directly pointed toward the target. After the first game throw, the player with the lowest score goes first in a subsequent round. A measuring string (or other suitable device) may be attached to or proximate the target to determine which stick end is nearest the target. The game may be played to any desired score (e.g., 38), and the winner must win by at least two points. When playing with partners (e.g., 5-8 players), two targets may be located at opposite ends of the playing field.

(ii) COLORS KNOCKOUT™

This exemplary game is played with 2-4 players, and without point totals. When played with two players, Player-A and Player-B each use a pair of pitch sticks—one pitch stick from the first game set and another pitch stick from the second game set. The two players alternate tossing pitch sticks from the pitch location towards a remote target (e.g., FRISBEE®) placed at the target location. The player with a pitch stick closest to the target is awarded a color-knockout; the section color (e.g., red, blue, green, or yellow) of the stick end most directly pointed towards the target. If the same player subsequently throws a closest pitch stick with a previously knocked out color, then this becomes a "wildcard throw" and he or she can choose any one of the remaining colors to knock out. The game ends when a player first knocks out all four colors.

(iii) Pitch Stick Bocce

This exemplary game is similar to the traditional "bocce ball" game, and may be played with 2-4 players. This game begins by tossing a target (e.g., FRISBEE®) from the pitch location to a remote target location. When playing with two players, each player throws a single game set of pitch sticks (e.g., 2 sticks)—alternating throws until all four sticks have been tossed towards the target. Only the player with a pitch stick nearest the target can score points in any frame. The scoring player receives one point for each pitch stick that is closer to the target than the closest pitch stick of the other player. The length of a game may be from 7 to 13 points.

(iv) Pitch Stick Cornhole

This game is similar to the yard game "cornhole", and may be played with 2-4 players located at opposite ends of the playing field near respective game targets (e.g., FRISBEES®). The players alternate throws from their pitch location towards their remote target location. A measuring string (or other device) attached to or proximate the targets may be used to determine whether a pitch stick lands on the "board". A throw on the board is awarded one point, while a throw which touches the target is awarded two points. The first player to 21 wins the game.

(v) Kubb/Defend Your King

Figure 4:
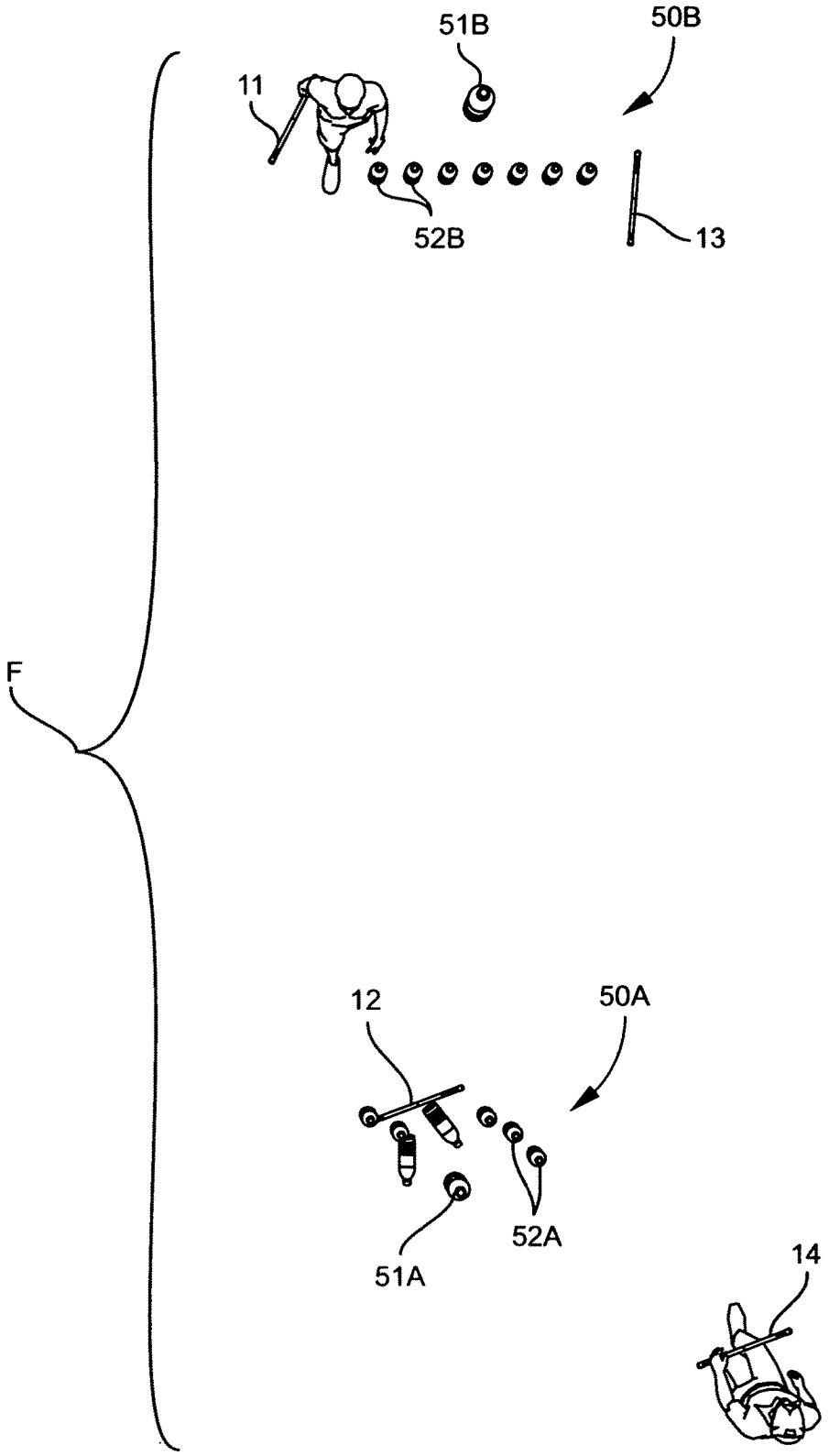
FIG. 4 illustrates one exemplary implementation of the present game kit for playing an outdoor game similar to the Swedish game "Kubb".

Referring to FIG. 4, this exemplary game is played by 2-4 players and requires 6-11 cans or plastic bottles 50A, 50B. Play is similar to the Swedish game "Kubb". For example, the players may be divided into two teams (two players each) with each team located on opposite ends of the playing field "F". One can or bottle is designated as the "king" 51A, 51B for each team. All other cans/bottles 52A, 52B are "pawns" Each team sets up all pawns and a king on its own side of the field. Using pitch sticks 11-14, the goal is to knockout (knock over) all the pawns of the opposing team before taking out the king. If the king is knocked over before all pawns have fallen, then the team is allowed to reset its king plus one previously-fallen pawn. The first team to knockout all pawns and lastly its king wins.

(vi) Chase

This game may be played with 2-8 players, and uses a throwable target (e.g., FRISBEE®). The game begins by throwing the target from the pitch location to a remote target location. Each player then throw one or more pitch sticks towards the target. Only the closest three pitch sticks are awarded points. The closest stick to the target gets 3 points, second closest stick gets 2 points, and the third closest stick gets 1 point. The player with the closest pitch stick in the round is allowed to throw the target to the next target location. The first player to 12 wins the game.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed:

1. A game kit for an outdoor tossing game, comprising:

a set of elongated rigid pitch sticks adapted to be tossed from a pitch location towards a remote target location, and comprising:

a first pitch stick having first and second visually contrasted stick sections, said first stick section comprising a first color identifier and a first point-indicating marking, and the second stick section comprising a second color identifier and a second point-indicating marking;

a second pitch stick having first and second visually contrasted stick sections, said first stick section comprising said first color identifier and a third point-indicating marking, and the second stick section comprising said second color identifier and a fourth point-indicating marking; and wherein the first and second visually contrasted stick sections of each pitch stick comprise substantially equal length-divided halves of said pitch stick.

2. The game kit according to claim 1, wherein the first and second color identifiers of said first and second pitch sticks comprise respective solid colors, each solid color extending substantially from a midpoint of said pitch stick outwardly to an end of said pitch stick.

3. The game kit according to claim 1, wherein the first point-indicating marking comprises a single color-contrasted band located within the first stick section of said first pitch stick, and wherein the second point-indicating marking comprises four spaced apart color-contrasted bands located within the second stick section of said first pitch stick, and wherein the third point-indicating marking comprises two spaced apart color-contrasted bands located within the first stick section of said second pitch stick, and wherein the fourth point-indicating marking comprises three spaced apart color-contrasted bands located within the second stick section of said second pitch stick.

4. The game kit according to claim 1, wherein each pitch stick is constructed substantially of wood.

5. The game kit according to claim 4, and comprising rubber end caps applied to respective ends of each pitch stick.

6. The game kit according to claim 5, wherein each pitch stick has a total length of between about 20 and 28 inches, and a diameter of between about 0.75 and 1.25 inches.

7. The game kit according to claim 1, and comprising a target adapted for being placed at the remote target location.

8. The game kit according to claim 7, and comprising means for measuring a distance extending from said target.

9. A game kit for an outdoor tossing game, comprising:

a first set of elongated rigid pitch sticks adapted to be tossed from a pitch location towards a remote target location, and said first set comprising:

(i) a first pitch stick having first and second visually contrasted stick sections, the first stick section comprising a first color identifier and a first point-indicating marking, and the second stick section comprising a second color identifier and a second point-indicating marking; and (ii) a second pitch stick having first and second visually contrasted stick sections, the first stick section comprising said first color identifier and a third point-indicating marking, and the second stick section comprising said second color identifier and a fourth point-indicating marking, wherein the first and second color identifiers of said first and second pitch sticks comprise respective solid colors, each solid color extending substantially from a midpoint of said pitch stick outwardly to an end of said pitch stick;

a second set of elongated rigid pitch sticks adapted to be tossed from the pitch location towards the remote target location, and said second set comprising:

(i) a third pitch stick having first and second visually contrasted stick sections, the first stick section comprising a third color identifier and said first point-indicating marking, and the second stick section comprising a fourth color identifier and said second point-indicating marking; and (ii) a fourth pitch stick having first and second visually contrasted stick sections, the first stick section comprising said third color identifier and said third point-indicating marking, and the second stick section comprising said fourth color identifier and said fourth point-indicating marking, wherein the third and fourth color identifiers of said third and fourth pitch sticks comprise respective solid colors, each solid color extending substantially from a midpoint of said pitch stick outwardly to an end of said pitch stick; and wherein the first and second visually contrasted stick sections of each pitch stick comprise substantially equal length-divided halves of said pitch stick.

10. The game kit according to claim 9, wherein the first point-indicating marking comprises a single color-contrasted band located within the first stick section of said first and third pitch sticks, and wherein the second point-indicating marking comprises four spaced apart color-contrasted bands located within the second stick section of said first and third pitch sticks, and wherein the third point-indicating marking comprises two spaced apart color-contrasted bands located within the first stick section of said second and fourth pitch sticks, and wherein the fourth point-indicating marking comprises three spaced apart color-contrasted bands located within the second stick section of said second and fourth pitch sticks.

11. The game kit according to claim 9, wherein each pitch stick is constructed substantially of wood.

12. The game kit according to claim 11, and comprising rubber end caps applied to respective ends of each pitch stick.

13. The game kit according to claim 9, and comprising a target adapted for being placed at the remote target location, and means for measuring a distance extending from said target.

* * * * *